United States Patent [19]

Murayama et al.

[11] Patent Number: 5,017,108

[45] Date of Patent: May 21, 1991

[54] SCROLL COMPRESSOR WITH FIRST AND SECOND OIL PUMPS IN SERIES

[75] Inventors: Akira Murayama; Naoshi Uchikawa; Takahiro Tamura; Takao Mizuno, all of Shimizu; Kazuo Sakurai, Shizuoka, all of Japan

[73] Assignee: Hitachi, Ltd., Tokyo, Japan

[21] Appl. No.: 488,942

[22] Filed: Mar. 5, 1990

Related U.S. Application Data

[63] Continuation of Ser. No. 185,380, Apr. 22, 1988, abandoned, which is a continuation-in-part of Ser. No. 895,301, Aug. 11, 1986, abandoned.

[30] Foreign Application Priority Data

Aug. 23, 1985 [JP] Japan ..... 60-184171
Oct. 14, 1985 [JP] Japan ..... 60-226730

[51] Int. Cl.[5] ..... F04C 18/04; F04C 29/02; F04B 23/12

[52] U.S. Cl. ..... 418/55.6; 418/88; 418/94; 418/171; 417/205; 184/6.18

[58] Field of Search ..... 418/55.6, 88, 94, 171; 417/201, 205; 184/6.16, 6.18

[56] References Cited

U.S. PATENT DOCUMENTS

| | | | |
|---|---|---|---|
| 3,317,123 | 5/1967 | Funke | 418/88 |
| 3,583,371 | 6/1971 | King | 418/88 |
| 4,403,927 | 9/1983 | Butterworth et al. | 418/88 |
| 4,462,772 | 7/1984 | Hazaki et al. | 418/94 |
| 4,609,334 | 9/1986 | Muir et al. | 418/57 |
| 4,623,306 | 11/1986 | Nakamura et al. | 418/88 |
| 4,637,786 | 1/1987 | Matoba et al. | 418/88 |
| 4,792,296 | 12/1988 | Kobayashi et al. | 418/55.6 |

FOREIGN PATENT DOCUMENTS

| | | | |
|---|---|---|---|
| 57-151093 | 9/1982 | Japan | 418/55.6 |
| 58-65986 | 4/1983 | Japan | 418/94 |
| 59-60092 | 4/1984 | Japan | 418/88 |
| 59-224493 | 12/1984 | Japan | 418/94 |
| 60-93192 | 5/1985 | Japan | 418/94 |

*Primary Examiner*—John J. Vrablik
*Attorney, Agent, or Firm*—Antonelli, Terry, Stout & Kraus

[57] ABSTRACT

A scroll compressor comprises an orbiting scroll and a fixed scroll, each of which has a wrap formed on an end plate in upstanding position. These orbiting and fixed scrolls are assembled together with the wraps facing inwardly to each other so as to define a plurality of spaces by the wraps and the end plates of both scrolls. These spaces move toward the center of both scrolls during the orbiting movement of the orbiting scroll so as to reduce the respective capacities of the spaces. Thus, compression of a fluid is carried out. This compressor also includes a motor for driving the orbiting scroll and a driving shaft for connecting the orbiting scroll and the motor. At the end of the driving shaft on the motor side, a first oil supply pump is provided with its suction port communicating to an oil sump of the compressor. Also, a second oil supply pump communicating with the discharge side of the second oil supply pump is provided at the end of the driving shaft on the compressor section side, whereby the oil supply pump of the compressor is made of a multistage type.

3 Claims, 9 Drawing Sheets

SCROLL COMPRESSOR WITH FIRST AND SECOND OIL PUMPS IN SERIES

This is a continuation of application Ser. No. 185,380, filed Apr. 22, 1988, abandoned, which was a continuation-in-part of application Ser. No. 895,301, filed Aug. 11, 1986, abandoned.

BACKGROUND OF THE INVENTION

The present invention relates to a scroll compressor for refrigeration or air-conditioning.

A scroll compressor of the aforementioned type is in, for example, U.S. Pat. No. 4,462,772, with the scroll compressor contained in a sealed chamber, wherein the lower end portion of a driving shaft is disposed in an oil sump of the compressor and an oil flow passage is formed through the shaft with a radial eccentricity. In this arrangement, a lubricating oil is supplied to rotating portions of the compressor by means of a centrifugal force generated in accordance with the magnitude of the eccentricity of the oil flow passage.

A disadvantage of the above-described arrangement resides in the fact that the lift or head of oil supply can not be made sufficiently large because the head depends on the diameter of the shaft, and more specifically, to that of the rotor section of a motor. In particular, as the centrifugal force is under the influence of a rotational speed of the shaft, a sufficient oil supply head can not be obtained when the rotational speed of the compressor varies due to, for example, the driving by an inverter, particularly during its operation at a low rotational speed.

Although the oil supply pump provided at the end of the driving shaft may be increased in capacity in order to overcome the above disadvantage, such increase brings another disadvantage that the arrangement becomes complicated in structure and increased in size.

SUMMARY OF THE INVENTION

An object of the invention is to provide a scroll compressor having an oil supply device which is reduced in size by forming its oil supply pump in a multistage type and which may provide a sufficient oil supply head and an increase in pumping ability of the pump.

According to the invention, there is provided a scroll compressor which comprises a scroll compressor section and a motor, with the compressor section and the motor being connected through a driving shaft and contained in a housing. The compressor section includes orbiting and fixed scrolls each having a spiral wrap formed on an end plate in upstanding position, with the scrolls being assembled together with their wraps facing inwardly to each other. The orbiting scroll is caused to move in an orbiting motion so that spaces defined by the wraps and end plates of both scrolls move toward the center of the scrolls while their capacities are successively reduced for compression of fluid. A first oil supply pump means is provided at an end of the driving shaft on the motor side, with the suction side of the first oil supply pump means being communicated to an oil sump in the housing. A second oil supply pump means is provided at an end of the driving shaft on the compressor section side which is the discharge side of the first oil supply pump means, thereby making oil supply pump means of multi-stages so that the pump means is increased in pumping ability while the structure thereof is simplified and reduced in size.

DETAILED DESCRIPTION

Figure 1:
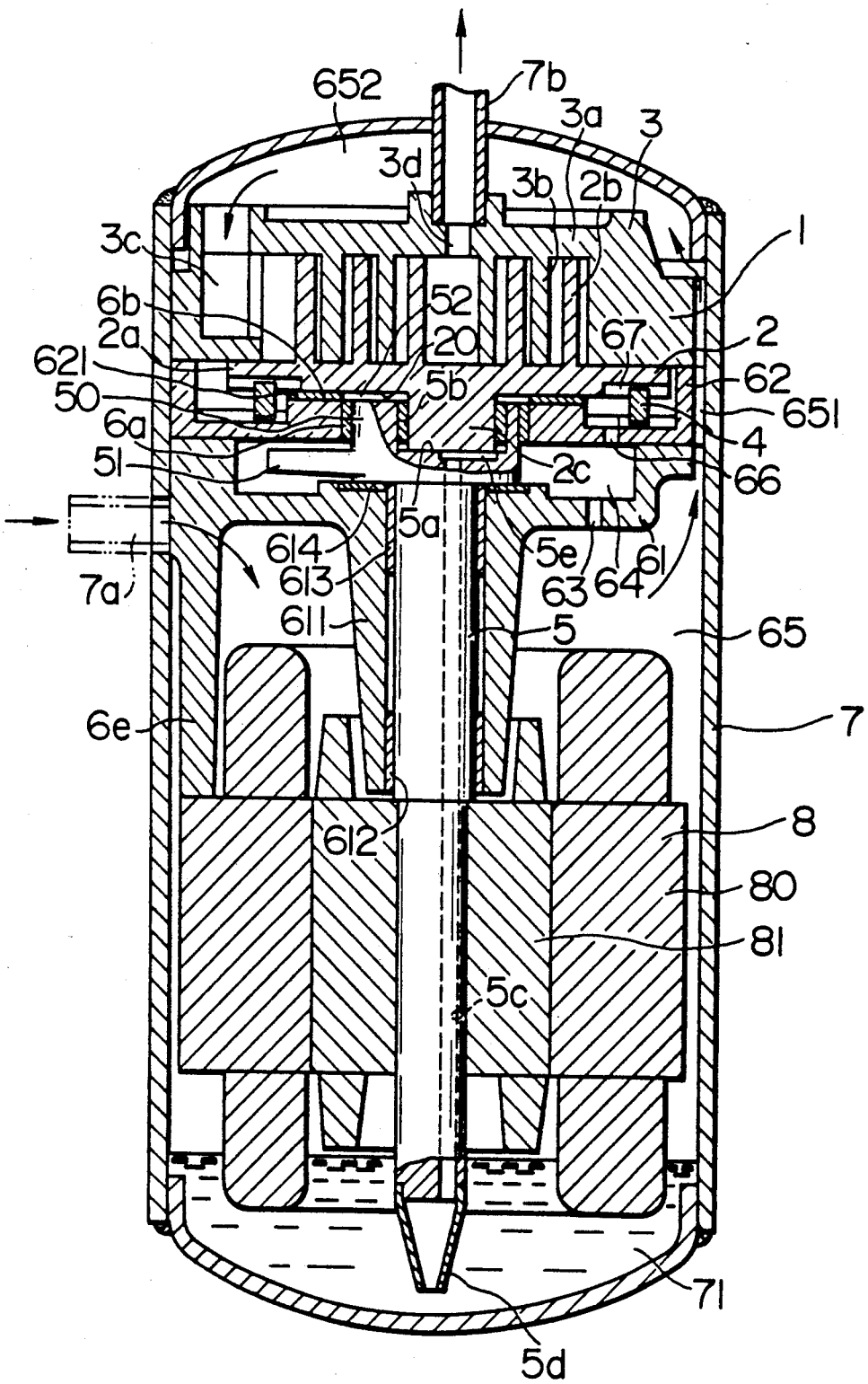
FIG. 1 is a cross sectional view of the scroll compressor according to an embodiment of the invention.
Figure 2:
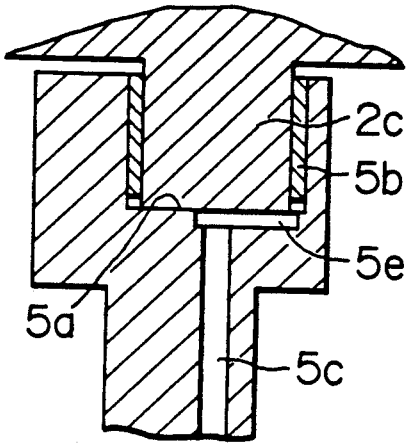
FIG. 2 is a fragmentary sectional view of a second oil supply pump and bearings of the compressor shown in FIG. 1.
Figure 3:
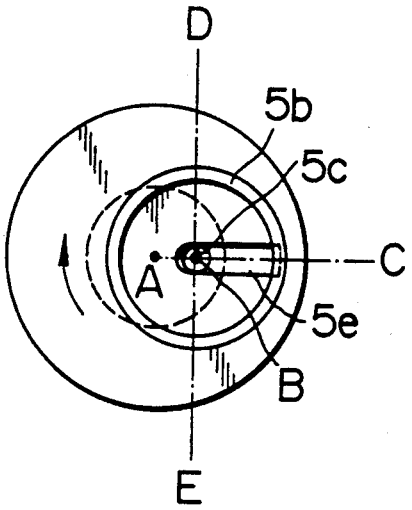
FIG. 3 is a plan view of the elements shown in FIG. 2.

Referring now to the drawings wherein like reference numerals are used throughout the various views to designate like parts and, more particularly, to FIGS. 1-3, according to these figures, a scroll compressor of the present invention includes a compressor section 1 including an orbiting scroll 2 having on an end plate **2*a* a wrap 2*b* of a spiral form and a fixed scroll 3 having a spiral wrap 3*b* on an end plate 3*a*, the orbiting scroll 2 and the fixed scroll 3 are assembled so that their respective wraps 2*b* and 3*b* are in engagement with each other. The compressor section 1 is fixedly mounted on a frame 62, and then on a frame 61 likewise. These frame portions 61 and 62 are force-fittedly set within a sealed container 7 in such a manner as to locate the compressor section 1 at an upper side of the container. A self-rotation preventive mechanism 4 for the orbiting scroll 2 is mounted within a space defined between the rear side of the orbiting scroll 2 and the frame 61**.

A driving shaft 5 includes an eccentric shaft portion 50 with an eccentric opening 5*a* and a balance weight portion 51, both of which are formed integrally at one end of the driving shaft. Also, a bearing 5*b* is mounted within the eccentric opening 5*a* to support a shaft 2*c* of the orbiting scroll 2. In addition, the outer periphery of the eccentric shaft portion 50 is rotatably supported by a bearing 6*a* which is fitted in the inner peripheral portion of the frame 62. A thrust bearing 6*b* is mounted between the rear surface 20 of the end plate 2*a* of the orbiting scroll 2 and the upper surface 621 of the frame 62. A clearance 52 serves as an oil feeding passage leading to the thrust bearing 6*b* and the bearing 6*a*. A groove 5*e* constituting a second oil supply pump is formed in the bottom of the eccentric opening 5*a*. A frustra-conical oil suction pipe 5*d* is provided at the other end of the driving shaft 5 with an end of the oil suction pipe 5*d* being submerged in an oil sump 71. The interior of the oil suction pipe 5*d* is communicated with an oil supply hole 5*c* formed eccentrically through the driving shaft 5. Thus the oil supply hole 5*c* and the oil suction pipe 5*d* constitute a first oil supply pump. Also, the upper end of the oil supply hole 5*c* communicates with the suction side of the groove 5*e* constituting the second oil supply pump.

A motor 8 includes a stator portion 80 is fixed to a distal end of a leg portion 6*e* of the frame 61 by, for example, a bolt-fastening. A rotator 81 is fixed on the driving shaft 5, and the driving shaft 5 is rotatably supported by main bearings 612 and 613 and a main thrust bearing 614 disposed on a bearing portion 611 of the frame 61. A pressure regulating hole 63 equalizes pressures between a chamber 64 and a low pressure chamber 65, with a pressure regulating hole 66 being provided for equalization of chambers 67 and 64. The sealed container 7 includes a suction pipe 7*a* below the frame 61 and a discharge pipe 7*b* communicating with a discharge port 3*d* above the fixed scroll 3, and these pipes are provided through the wall of the sealed container 7. A gas passage 651 communicates the low pressure chamber 65 with a space 652 defined over the end plate 3*a* of the fixed scroll 3 within the sealed container 7. A suction passage 3*c* is provided in the fixed scroll 3 and communicates with both the space 652 and a compressible suction chamber defined by the wraps 2*b* and 3*b*.

The shaft 2*c* of the orbiting scroll is disposed in the eccentric opening 5*a* of the driving shaft 5 with a fine clearance left between the end surface of the shaft 2*c* and the bottom portion of the eccentric opening 5*a*. The groove 5*e* is formed to extend in a radial direction outwardly from the oil supply hole 5*c*, which direction is substantially the same as the direction of eccentricity of the oil supply hole 5*c*.

As shown in FIG. 3, when this radial groove 5*e* is disposed at a certain location in the semi-circular area DE which extends within the angular range of ±90° with respect to the line connecting the center A of the driving shaft and the center B of the eccentric opening and extending beyond the center B as shown at C, a radial distance from the center A of the driving shaft 5 to the extremity of the groove 5*c* may be made larger and becomes more effective for oil supplying.

The gas suction through the suction pipe 7*a* from the low-pressure side of a refrigeration cycle such as an evaporator or the like, is drawn through the suction passage 3*c* of the fixed scroll 3 after cooling the motor 8. Then, the gas is compressed by the orbiting scroll 2 and the fixed scroll 3 to be discharged from the discharge pipe 7*b* through the discharge port 3*d* to the high pressure side of the refrigeration cycle such as a condenser or the like.

The oil supplying is effected by the first oil supply pump, which is constituted by the frusta-conical oil suction pipe 5*d* formed at the lower end of the driving shaft 5 and immersed in the oil sump 71 in the lower portion of the sealed container 7 and the eccentric oil supply hole 5*c*. The oil reaching the eccentric opening 5*a* of the driving shaft 5 is further pressurized by the second oil supply pump, and delivered to a series channel of the bearings 5*b* and 6*a* and a series channel of the bearing 5*b* and the thrust bearing 6*b*. Thus, the oil to be fed to the bearings is pressurized twice by the first and the second oil supply pump, so that the bearing 6*a* and the thrust bearing 6*b* remote from the pumps can sufficiently be supplied with oil through the clearance 52.

The oil which has performed the lubrication of the thrust bearing 6*b* is discharged into the chamber 67, and then dropped into the chamber 64 through the pressure regulating hole 66. In the chamber 64, the oil from the bearing 6*b* joins with the oil which has lubricated the bearing 6*a* and drops into the chamber 65 through the pressure regulating hole 63. Subsequently, the oil drops into the oil sump 71 through gaps such as that at the outer periphery of the motor 8, and is stored in the oil sump 71.

Figure 4:
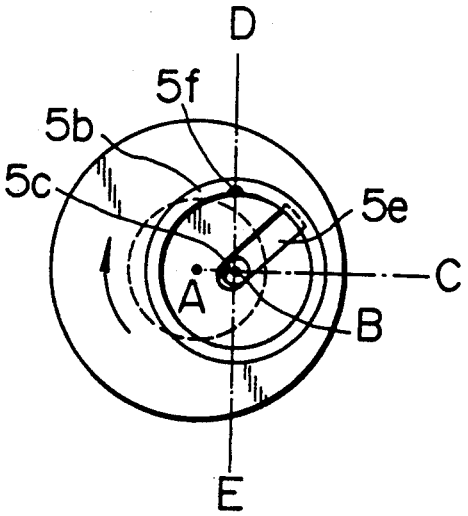
FIG. 4 is a plan view of the second oil supply pump of the compressor according to another embodiment of the invention.

As shown in FIG. 4, there is provided an oil groove 5*f* in the inner surface of the bearing 5*b* which is disposed in the eccentric opening of the driving shaft. When this oil groove 5*f* is formed in the same direction as the radial groove 5*e* formed in the bottom portion of the eccentric opening or on the downstream side with respect to the rotating direction of the groove 5*e*, oil can be supplied to the loading points of the bearings appropriately. According to this embodiment, the groove 5*e* is angularly displaced by 45° with respect to the extension line C and oil supply pressure can be increased, and oil can be delivered to appropriate portions to be supplied with the oil.

Figure 5:
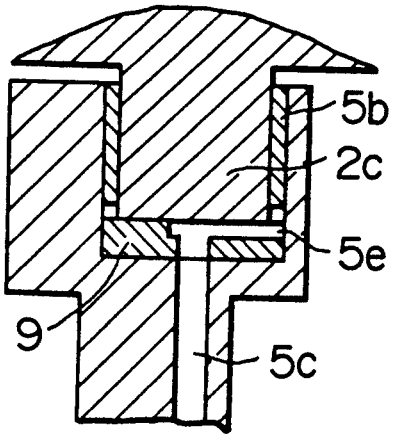
FIG. 5 is a cross sectional view of the second oil supply pump of the compressor according to further embodiment of the invention.

As shown in FIG. 5, a member 9 provided with the radial groove 5*e* may be formed separately to be fixedly secured on the bottom portion of the eccentric opening, so that the groove 5*e* will readily be manufactured.

Figure 6:
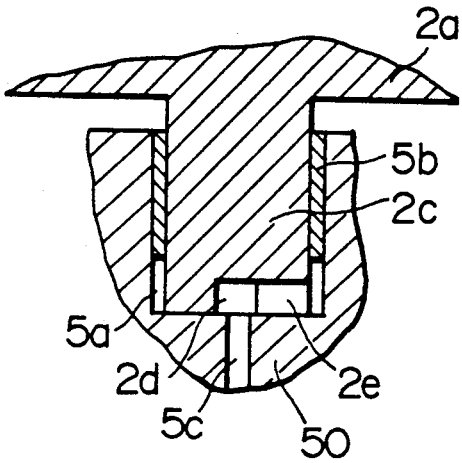
FIG. 6 is a cross-sectional view of the second oil supply pump of the compressor according to further another embodiment of the invention.
Figure 7:
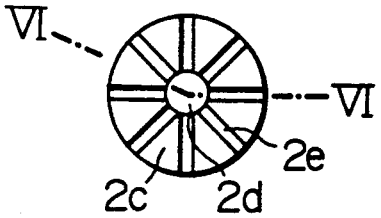
FIG. 7 is a fragmentary plan view of the pump shown in FIG. 6.

As shown in FIGS. 6 and 7, the shaft 2*c* of the orbiting scroll is arranged in the eccentric opening 5*a* of the driving shaft 5 with a slight clearance left between the end surface of the shaft 2*c* and the bottom portion of the eccentric opening 5*a*. The shaft 2*c* includes at its center a hole 2*d* opposite to the oil supply hole 5*c* and opening toward the bottom portion of the eccentric opening of the driving shaft, and a plurality of grooves 2*e* formed to radially extend from the hole 2*d*.

The oil which has come into the hole 2*d* from the oil supply hole 5*c* is pressurized by the grooves 2*e*, and supplied to the bearing 5*b* and the bearing 6*a* or 6*b* in series.

Figure 8:
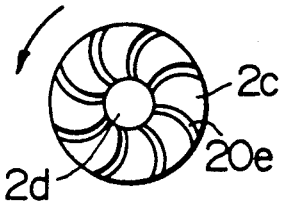
FIG. 8 is a plan view of the second oil supply pump of the compressor according to still another embodiment of the invention.

As shown in FIG. 8, the radial grooves 2*e* (FIG. 7) may be modified to curved grooves 20*e* to further increase the pressurizing effect, with the direction of rotation of the shaft 2*c* of the orbiting scroll 2 being indicated by the arrow in FIG. 8.

Figure 9:
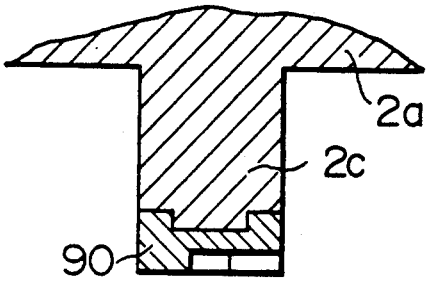
FIG. 9 is a fragmentary cross sectional view of the shaft portion of the compressor having the second oil supply pump shown in FIG. 8.

Moreover, for the purpose of facilitating the manufacturing of these grooves, as shown in FIG. 9, a pump mechanism 90, formed separately from the shaft 2c of the orbiting scroll 2, may be secured to the proximal end thereof.

Figure 10:
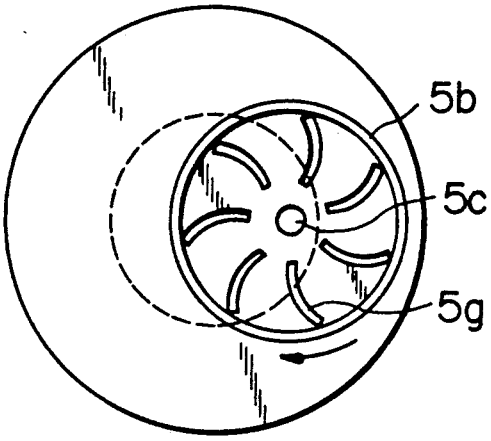
FIGS. 10 and 11 are plan views of the second oil supply pumps of the compressors according to still other embodiments of the invention respectively.
Figure 11:
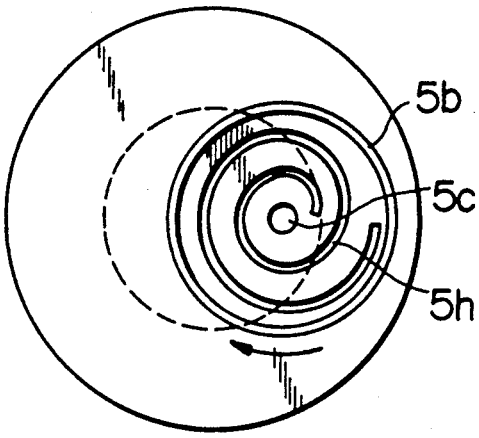

As for the pump mechanism described above, in addition to the structures of the embodiments shown in FIGS. 6 to 9 wherein centrifugal force is mainly utilized as working force, such a pump mechanism as curvilinear grooves 5g or a spiral groove 5h shown in FIGS. 10 and 11 in which the use of viscous force is also taken account of may be employed.

Even when the grooves of the above two embodiments have complex forms, they can easily be manufactured by forming them separately from the driving shaft, as the embodiment shown in FIG. 9.

FIGS. 10 and 11 illustrate second oil supply pumps of scroll compressors of the present invention and represent arrangements wherein the pump portions are provided on the side or shaft 2c of the oribiting scroll member, with the direction of rotation of the scroll compressors being indicated by the arrows.

Figure 12:
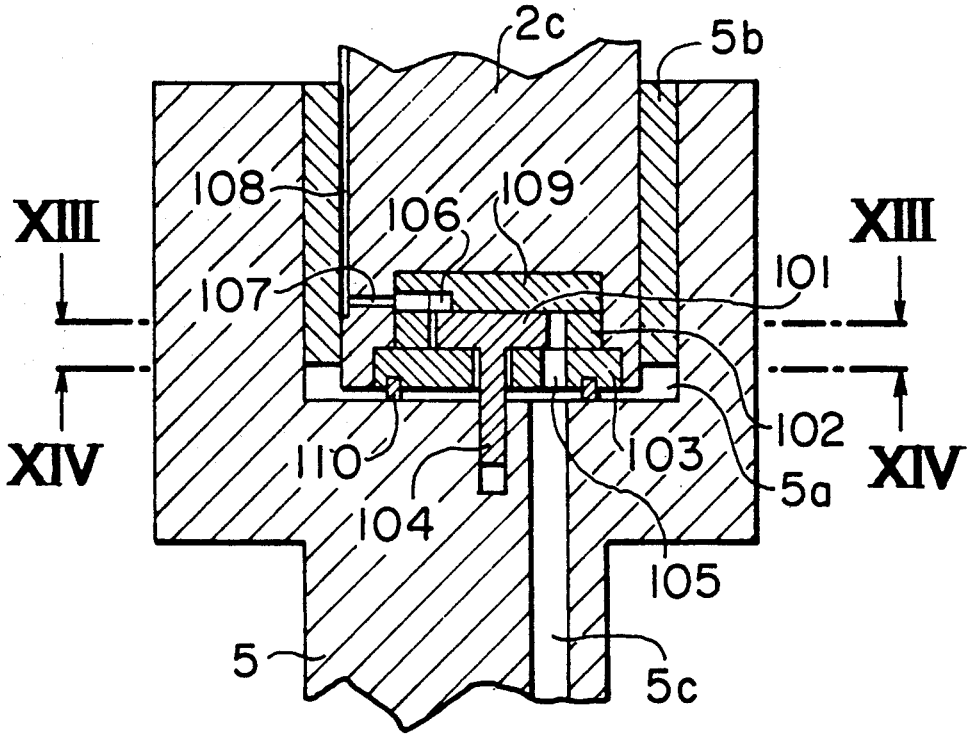
FIG. 12 is a fragmentary cross sectional view of the second oil supply pump and bearings of the compressor according to further another embodiment of the invention.
Figure 13:
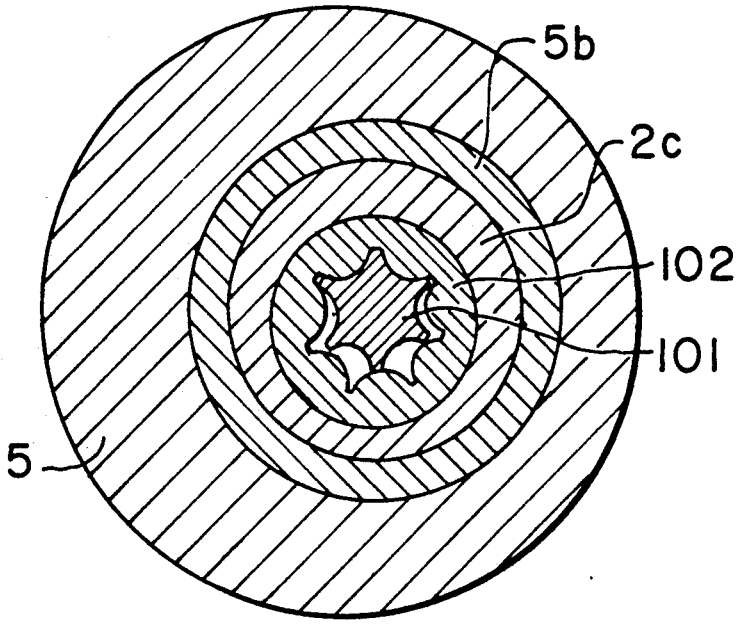
FIG. 13 is a cross sectional view taken along the line XIII-XIII of FIG. 12.
Figure 14:
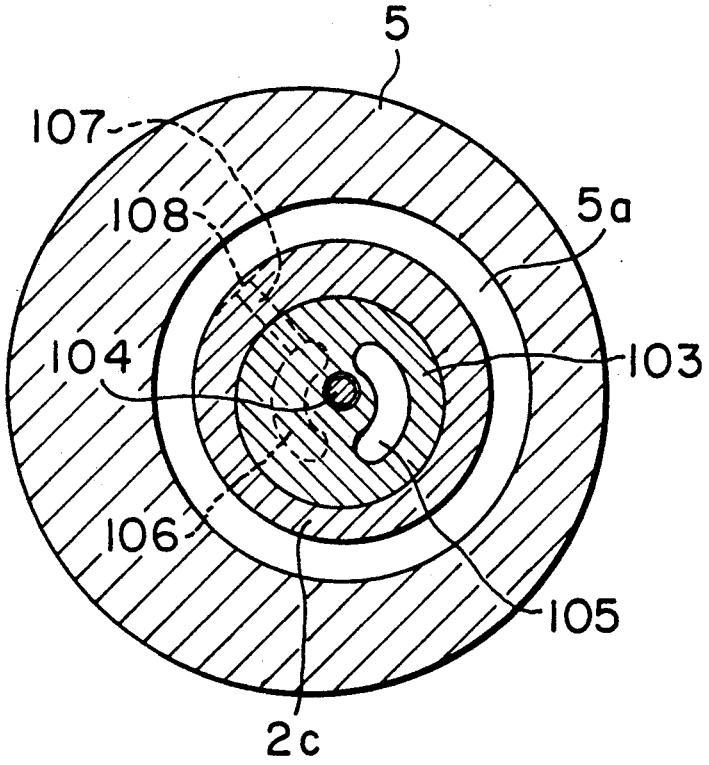
FIG. 14 is a cross-sectional view taken along the line XIV-XIV of FIG. 12.

FIGS. 12 to 14 show a further embodiment of the present invention and, as shown most clearly in FIG. 12, a second oil supply pump of a trochoid type is provided in the free end of the shaft 2c of the oribiting scroll 2. The trochoid pump comprises an inner rotor 101 and an outer rotor 102 surrounding the inner rotor 101. The inner and outer rotors 101, 102 are housed, together with a bottom plate 109, in a circular hole which is formed in the free end of the shaft 2c.

The inner rotor 101 has outer teeth provided along trochoidal curves, and the outer rotor 102 has inner teeth profiled to be operative in engagement with the outer teeth of the inner rotor 101, as shown in FIG. 13. The inner teeth of the outer rotor 102 are larger in number by one than the outer teeth of the inner rotor 101. The inner rotor 101 has its axis or center of rotation in alignment with the axis of the shaft 2c, while the outer rotor 102 and circular hole in the shaft 2c are eccentric to the shaft 2c. Alternatively, an eccentric ring member may be provided and mounted in the circular hole of the shaft 2c, so that the circular hole can be formed concentrically with the shaft 2c.

A cover 103 is provided on a free end of the shaft 2c to close the circular hole in which the rotors 101, 102 are received. The cover 103 is fixedly press-fitted into the circular hole of the shaft 2c as shown in FIG. 12, but it may alternatively be fixed on the shaft 2c by means of bolts or the like. The inner rotor 101 has a shaft 104 extending downwardly therefrom through the cover 103. The shaft 104 is coupled to the driving shaft 5 such that at least its rotational motion depends upon the driving shaft 5 or the force can be delivered from the driving shaft 5 to the inner rotor 101.

The cover 103 has an intake port 105 formed in an arcuate shape as shown in FIG. 14, with a discharge port 106 of a similar arcuate shape is formed in the bottom plate 109 on the side thereof facing the inner rotor 101. The intake and discharge ports 105, 106 are positioned, as viewed in a direction perpendicular to the plane of FIG. 14, opposite to each other with the axis of the inner rotor 101 interposed therebetween, and respectively extending substantially along a direction in which the outer rotor 102 is eccentric relatively to the inner rotor 101. The discharge port 106 communicates with an axial oil supply groove 108 of the shaft 2c through an oil supply hole 107.

The groove 108 is formed in an outer periphery of the shaft 2c, and the oil hole 107 is radially formed in the shaft 2c. The disposition of the discharge port 106 in the bottom plate 109 may be facilitate the forming or machining of this port; however, if no bottom plate is provided, the discharge port 106 may be formed directly in the bottom of the circular hole in the shaft 2c. The oil supply groove 108 is formed within the region where the bearing 5b faces or covers the shaft 2c, so that an unfavorable communication of the discharge side of the second oil supply pump with the intake side thereof is prevented. An annular seal member 110 is provided between the cover 103 and the driving shaft 5 to ensure the prevention of this unfavorable communication.

When the driving shaft 5 rotates to cause a relative rotational motion between the shaft 5 and the shaft 2c, the inner rotor 101 is driven by the driving shaft 5 to rotate, and the outer rotor 102 rotatably received in the circular hole of the shaft 2c also rotates following the rotation of the inner rotor 101. As a result, lubrication oil through the intake port 105 is raised in pressure, and then discharged through the discharge port 106.

With the embodiment of FIGS. 12–14, when the compressor starts operating, the driving shaft is driven to rotate by a motor and, upon rotation of the driving shaft 5, the shaft 2c rotatably received in the eccentric opening 5a of the driving shaft 5 orbits about the axis of the shaft 5, so that the orbiting scroll orbits relative to the fixed scroll. Additionally, the inner rotor 101 eccentrically and fixedly coupled to the driving shaft 5 orbits about the axis of the shaft 5. As the inner rotor 101 is arranged concentrically with the shaft 2c on which the intake and discharge ports 105, 106 are fixedly mounted, the orbiting motion of the inner rotor 101 is synchronous with that of the shaft 2c and the relationship in position between the inner rotor 101 and intake and discharge ports 105, 106 is maintained constant or unaltered even through they are orbiting.

At the same time, since the shaft 2c orbits without rotating about its own axis while the driving shaft 5 rotates, a relative rotational movement is caused between them in the amount of once per orbiting motion of the shaft 2c. The above movement causes the inner rotor 101 and the shaft 2c to rotate relative to each other. Because some of the teeth of the inner rotor 101 mesh with those of the outer rotor 102 which is rotatably received in the shaft 2c, the inner rotor 101 drives the outer rotor 102 for rotation.

The teeth of the inner and outer rotors 101, 102 successively mesh with one another, as the inner and outer rotors 101, 102 are rotating, in a region which is fixed in position relative to the intake and discharge ports 105, 106. Thus, chambers between the teeth of the inner and outer rotors 101, 102 successively expand to such oil through the intake port 105 and then contract to raise the oil and pressure and discharge the same through the discharge port 106.

In the embodiment of FIGS. 12–14, the second oil supply pump is of a trochoidal type having a more positive structure as a pump. Therefore, it is possible to more effectively raise or boost the pressure of the lubrication oil which has been once raised by the first oil pump means. The second oil supply pump of the embodiment is capable of raising the pressure of oil to a certain level irrespective of its rotational speed. Accordingly, the embodiment of FIGS. 12–14 is particularly well suited for a compressor which performs a low speed operation under speed control by inverter means.

The second oil supply pump of FIGS. 12–14, as having the capacity of raising pressure of lubricating oil to a constant level irrespective of the speed of rotation, can be used jointly with lubrication oil supply means utilizing a differential between suction and discharge pressures of gas in a compressor of a high pressure chamber type. Moreover, the second oil pump may be used alone for a lubrication oil supply system in a scroll compressor.

Moreover, the second oil pump of the embodiment of FIGS. 12–14 is applicable, with a slight modification of the position of the intake and discharge ports 105, 106, also to a compressor which has a scroll compressor section disposed in a lower portion of a container or a horizontal type compressor in which compressor and motor sections are arranged horizontally. For example, when applying this second oil pump to the former compressor, the discharge port is formed in the cover 103 while the intake port is formed in the bottom plate 109 or the bottom of the circular hole in the shaft 2*c*, and additional means are provided for communicating the oil supply hole 5*c* with the intake port. In this case, the oil supply hole 107 and seal member 110 are unnecessary.

Figure 15:
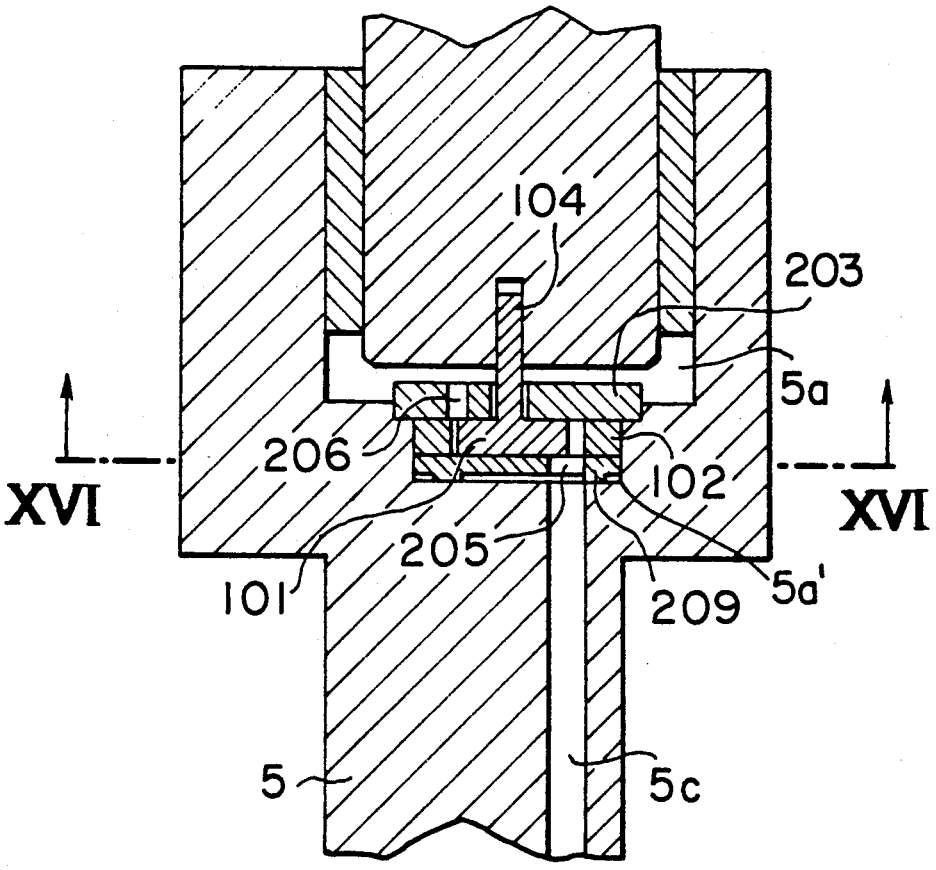
FIG. 15 is a fragmentary cross-sectional view showing a modification of the embodiment shown in FIG. 12.
Figure 16:
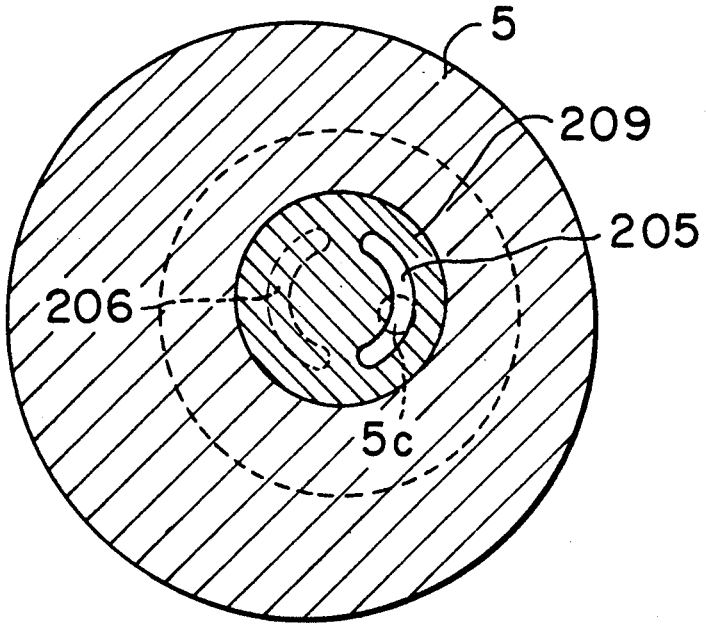
FIG. 16 is a cross-sectional view taken along the line XVI-XVI of FIG. 15.

FIGS. 15 and 16 provide a modification of the above embodiment, wherein the second oil supply pump of the trochoid type is disposed in the bottom of the eccentric hole 5*c* of the driving shaft 5.

In the modification of FIGS. 15 and 16, the inner rotor 101 is arranged concentrically with the eccentric hole 5*a*, and the outer rotor 102 is rotatably mounted in a circular hole 5*a'* which is formed in the bottom of the hole 5*a* eccentrically thereto. A cover 203 is provided to close the circular hole 5*a'* and the shaft 104 of the inner rotor 101 extends upward through the cover 203 to be coupled with the shaft 2*c* of the orbiting scroll. As shown in FIG. 16, a discharge port 206 of an arcuate shape is formed through the cover 203, and an intake port 205 of a similar arcuate shape is formed through a bottom plate 209 which is also housed in the circular hole of the shaft 5*a*. The intake port 206 may be formed in the bottom of the circular hole if no bottom plate is provided. The intake port 205 communicates with the oil supply hole 5*c* in the driving shaft 5. The second oil pump of the embodiment of FIGS. 15 and 16 operates in a similar manner to the embodiment shown in FIGS. 12–14 by a relative rotational movement between the driving shaft 5 and the shaft 2*c*.

In the embodiment of FIGS. 15 and 16, when the compressor starts operating, the driving shaft 5 is driven to rotation by a motor and, upon rotation of the driving shaft 5, shaft 2*c*, rotatably received in the eccentric opening 5*a* of the driving shaft 5, orbits about the axis of the shaft 5, so that the oribiting scroll orbits relative to the fixed scroll. Additionally, the inner rotor 101, fixedly coupled to the shaft 2*c*, orbits therewith about the axis of the shaft 5. As the intake and discharge ports 205, 206 are fixedly mounted on the driving shaft 5 eccentrically with respect to the inner rotor 101, the intake and discharge ports 205 and 206 also orbit about the axis of the shaft 5 synchronously with the inner rotor 101. Accordingly, a positional relationship between the inner rotor 101 and intake and discharge ports 205, 206 is maintained constant or altered even through they are orbiting. At the same time, since the shaft 2*c* orbits without rotating about its own axis while the driving shaft 5 rotates, a relative rotational movement is caused between them in the amount of once per orbiting motion of the shaft 2*c*.

The above movement causes the inner rotor 101 and driving shaft 5 to rotate relative to each other. Because some of the teeth of the inner rotor mesh with the teeth of the outer rotor 102, rotatably received in the shaft 5, the inner rotor 101 drives the outer rotor 102 for rotation. The teeth of the inner and outer rotor 101, 102 successively come to mesh with one another, as the inner and outer rotors 101, 102 are rotating, in a region which is fixed in a relative position to the intake and discharge ports 205, 206. Thus, chambers between the teeth of the inner and outer rotors 101, 102 expand to suction oil through the intake port 205, and then contract to raise the oil and pressure and discharge the same through the discharge port 206.

Since the intake port 205 of the embodiment of FIGS. 15 and 16 is fixed in relative position to the oil supply hole 5*c*, the configuration and positioning of the intake port 205 may be simplified. As the eccentric hole 5*a* is under the discharge pressure of the lubrication oil, there is no fear of an unfavorable communication between the suction and discharge sides of the pump as described in connection with the embodiment of FIGS. 12–14. Thus, the embodiment of FIGS. 15 and 16 require no such additional means as a seal and so on for preventing the communication. The second oil pump of the embodiments of FIGS. 15 and 16 is suited for a compressor having a compressor section arranged in an upper portion of the container or a horizontal type compressor in which the lubrication oil is supplied through the driving shaft 5, while being applicable also to the compressors of the aforementioned type wherein lubrication oil is supplied to the shaft 2*c*.

Figure 17:
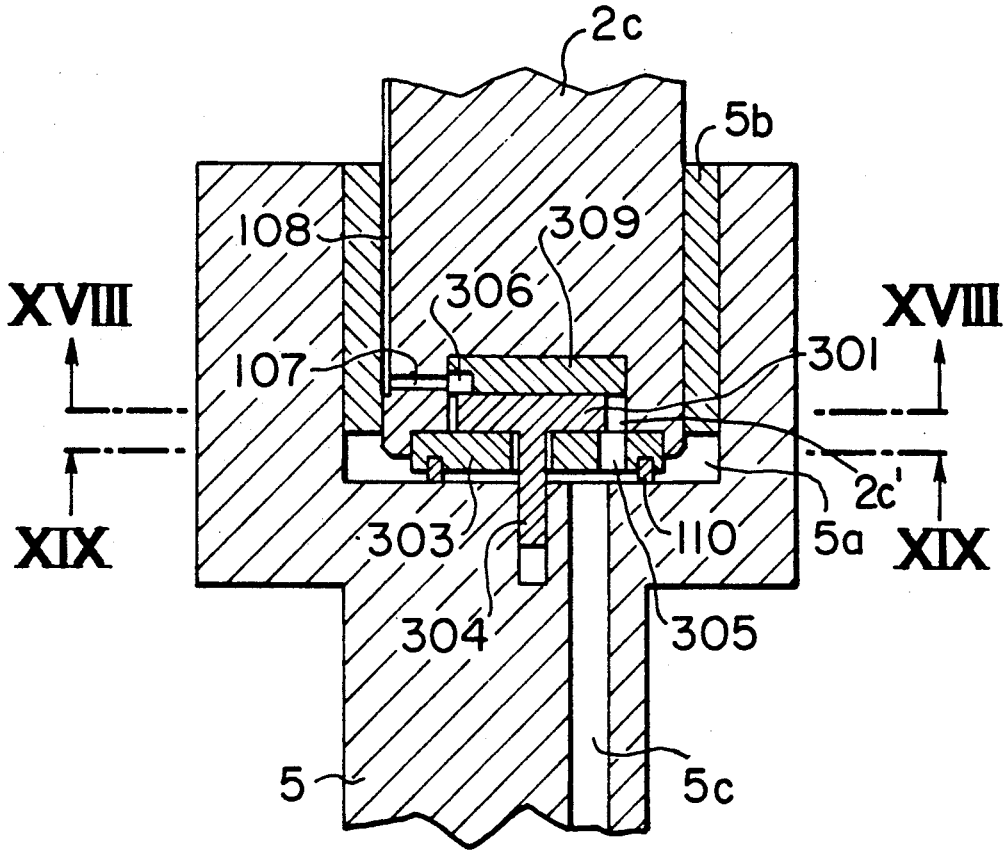
FIG. 17 is a fragmentary cross-sectional view showing a portion of the compressor of yet another embodiment of the present invention.
Figure 18:
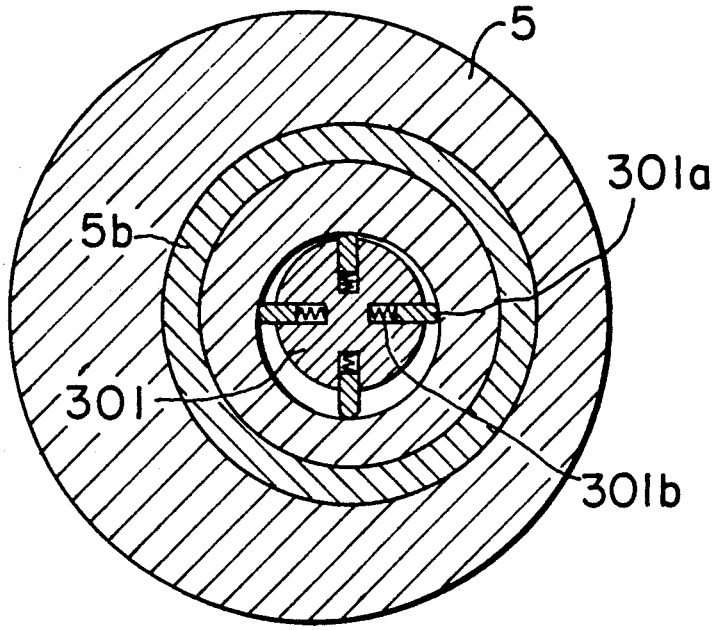
FIG. 18 is a cross-sectional view taken along the line XVII-XVII of FIG. 17.
Figure 19:
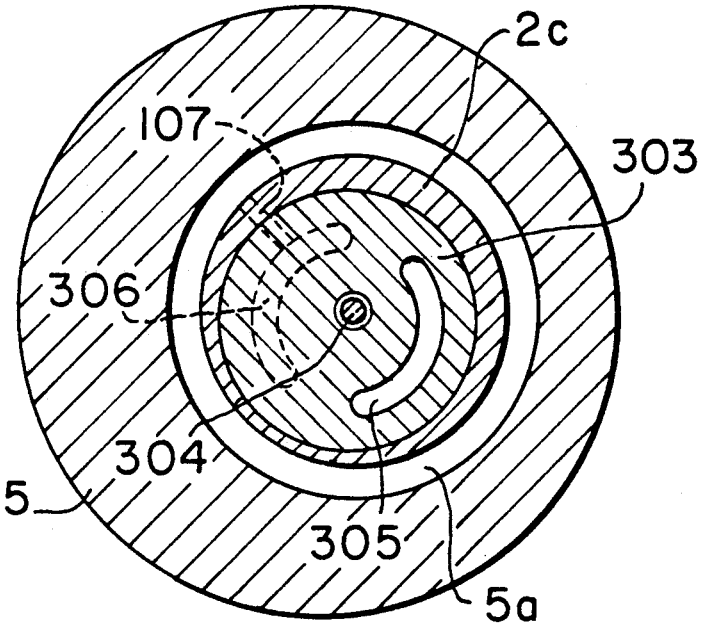
FIG. 19 is a cross-sectional view taken along the line XIX-XIX of FIG. 17.

Yet another embodiment of the present invention is illustrate in FIGS. 17–19, wherein the second oil supply pump of this embodiment is of so-called vane type and is provided in the free end of the shaft 2*c* of the orbiting scroll.

Referring to FIG. 17, formed in the free end of the shaft 2*c* is an eccentric circular hole 2*c'* in which a rotor 301 is concentrically housed with the shaft 2*c*. The rotor 301 has a plurality of radial grooves arranged at an equal circumferential spacing, with four grooves being provided in the illustrated embodiment and shown in FIG. 18. A vane 301*a* is slidably received in each radial groove, and a spring 301*b* is provided at the bottom of each radial groove to radially press the associated vane 301*a* against the wall of the circular hole. A cover 303 is provided on the free end of the shaft 2*c* to close the circular hole. The rotor 301 has a shaft 304 which extends downwardly through the cover 303 and is coupled to the driving shaft 5 for rotation therewith. As with the embodiment shown in FIGS. 12–14, a circular bottom plate 309 is received in the circular hole of the shaft 2*c*. An intake port 305 and a discharge port 306 are respectively formed in the cover 303 and the bottom plate 309. The other structure of the compressor of FIGS. 17–19 is the same as that discussed hereinabove in connection with the embodiment of FIGS. 12–14.

Upon rotation of the driving shaft 5, the rotor 301 is driven to rotate relative to the circular hole of the shaft 2*c*. The vanes 301*a* are kept in slide contact with the wall of the circular hole by the springs 301*b* while reciprocating radially as the rotor 301 rotates. Lubrication oil through the intake port 305 is confined in each space between adjacent vanes 301*a*, raised in pressure as the space is being decreased in volume and discharged through the discharge port 306. The compressor of the embodiment of FIGS. 17–19 may achieve similar meritorious effects to those described in connection with the embodiment of FIGS. 12–14.

With the embodiment of FIGS. 17–19, when the compressor starts operating, the driving shaft 5 is driven for rotation by a motor and, upon rotation of the driving shaft 5, the shaft 2*c*, rotatably received in the eccentric opening 5*a* of the driving shaft 5, orbits about the axis of the shaft 5 so that the orbiting scroll orbits relative to the fixed scroll. Additionally, the vaned inner rotor 301 eccentrically and fixedly coupled to the driving shaft 5, orbits about the axis of the shaft 5. As the inner rotor 301 is arranged concentrically with shaft 2*c* on which intake and discharge ports 305, 306 are fixedly mounted, the orbiting motion of the inner rotor 301 is synchronous with that of the shaft 2*c*, and the positional relationship between the inner rotor 301 and the intake and discharge ports 305, 306 is maintained constant or unaltered even though they are orbiting.

At the same time, since the shaft 2*c* orbits without rotating about its own axis while the driving shaft 5 rotates, a relative rotational movement is caused between them in the amount of once per orbiting motion of the shaft 2*c*.

The above movement causes the inner rotor 301 and the shaft 2*c* to rotate relative to each other, and the plurality of vanes of the rotor 301 move along the inner wall of the circular hole in the shaft 2*c* while being kept in contact therewith, in which hole the inner rotor 301 is eccentrically received. Accordingly, the chambers between the vanes rotate to successively expand to suction oil through the intake port 305 and then contract to raise the oil and pressure and discharge the same through the discharge port 306.

Figure 20:
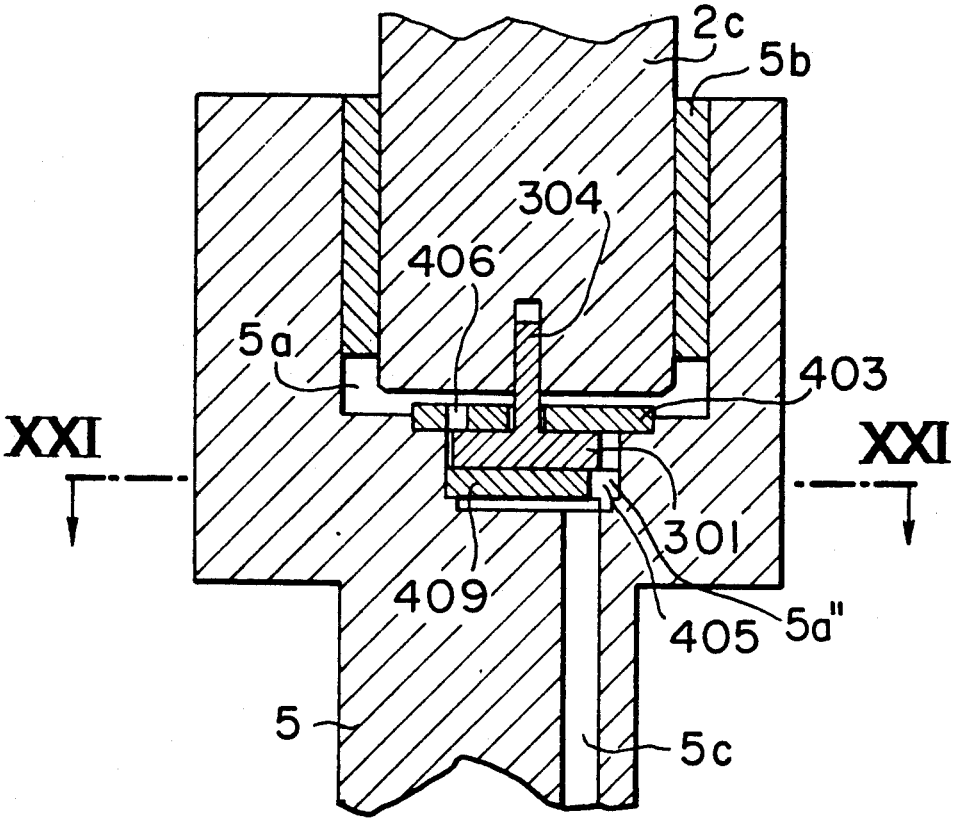
FIG. 20 is a fragmentary sectional view showing a modification of the embodiment shown in FIG. 17.
Figure 21:
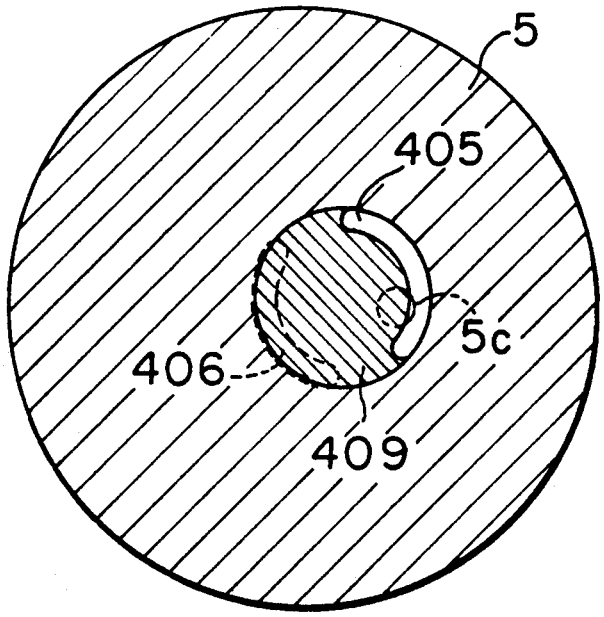
FIG. 21 is a cross-sectional view taken along the line XXI-XXI of FIG. 20.

In the embodiment of FIGS. 20 and 21, an eccentric hole 5*a*″ is formed in the upper end of the driving shaft 5, in which the hole 5*a*″ a bottom plate 409 and the rotor 301 with the vanes 301*a* and springs 301*b* are received. A cover 403 is secured on the upper end of the shaft 5 to close the circular hole 5*a*″. The rotor 301 is arranged concentrically with the eccentric hole 5*a*, and the shaft 304 of the rotor 301 extends upward through the cover 403 to be coupled with the shaft 2*c* for rotation therewith. A discharge port 406 and an intake port 405 are formed in the cover 403 and the bottom plate 409, respectively. The second oil supply pump of the embodiment of FIGS. 21 and 21 operates in a manner similar to that described hereinabove in connection with the embodiment of FIGS. 17–19.

With the embodiment of FIGS. 20 and 21, when the compressor starts operating, the driving shaft 5 is driven to rotation by a motor and, upon rotation of the driving shaft 5, the shaft 2*c*, rotatably received in the eccentric opening 5*a* of the driving shaft 5 orbits about the axis of the shaft 5, so that the oribiting scroll orbits relative to the fixed scroll. Additionally, the inner rotor 301, fixedly coupled to the shaft 2*c* also orbits therewith about the axis of the shaft 5. Furthermore, as the intake and discharge ports 405, 406 are fixedly mounted on the driving shaft 5 eccentrically with respect to the inner rotor 301, the intake and discharge ports 405, 406 also orbit about the axis of the shaft 5 synchronously with the inner rotor 301. Accordingly, a positional relationship between the inner rotor 301 and the intake and discharge port 405, 406 is maintained constant or unaltered even though are orbiting.

At the same time, since the shaft 2*c* orbits without rotating about its own axis while the driving shaft 5 rotates, a relative rotational movement is caused between them in the amount of once per orbiting motion of the shaft 2*c*. This movement causes inner rotor 301 and the driving shaft 5 to rotate relative to each other, and the plurality of vanes of the inner rotor 301 move along the inner wall of the circular hole in the shaft 5 while being kept in contact therewith, in which hole the inner rotor 301 is eccentrically received. Thus, the chambers between the vanes rotate to successively expand to suction oil through the intake port 405 and then contract to raise the oil in pressure and discharge the same through the discharge port 406.

In above described embodiments, the driving shaft 5 has an eccentric hole formed therein for receiving the shaft of the orbiting scroll. However, it will be appreciated that the invention is applicable also to a compressor structure in which a driving shaft has a crank pin provided at one end thereof and an orbiting scroll has a hole for receiving the crank pin.

According to the present invention, the lift of head of the oil supply pump is increased while being simplified in structure, so that oil can be supplied stably and uniformly. Even when a low speed operation with variable speed drive such as an inverter drive is utilized, a sufficient oil supply can be attained.

What is claimed is:

1. A scroll compressor comprising:

a housing having an oil sump defined therein;

a compressor section contained in the housing and including orbiting and stationary scrolls, the orbiting and the stationary scrolls each having an end plate and a spiral wrap formed uprightly on the end plate and being assembled together with the spiral wraps meshing with each other;

driving means connected to the compressor section through a driving shaft for moving the orbiting scroll in an orbiting motion to compress fluid in spaces defined by the spiral wraps and end plates of both scrolls, said orbiting scroll has a portion formed thereon for connection to the driving shaft;

a first oil supply pump means communicating with the oil sump, the first oil supply pump means being associated with the driving shaft to rotate therewith for delivery of oil in the oil sump by a centrifugal force; and a second oil supply pump means provided in a connection between the driving shaft and the orbiting scroll and associated, for driving thereof, with at least one of the driving shaft and the orbiting scroll, the second oil supply pump means communicating with a discharge side of the first oil supply pump means so as to raise a pressure of oil, which has been once raised by the first oil supply pump means, for supplying sufficient oil to at least two sliding bearings disposed in series on a discharge side of the second oil supply pump means, said second oil supply pump means comprises a gear pump including inner and outer rotors, said inner rotor having outer teeth and said outer rotor having inner teeth profiled to be operatively engageable with the outer teeth of said inner rotor, said outer rotor being rotatably accommodated in a hole which is formed in one of an end of the connection portion of the orbiting scroll and an end of the driving shaft opposite thereto, said inner rotor being eccentrically disposed in said outer rotor and connected, for driving thereof, to the other of the connection portion of the orbiting scroll member and the driving shaft so that said inner rotor rotates relative to said outer rotor to compress oil in spaces between the teeth of both rotors meshing with one another.

2. A scroll compressor according to claim 1, wherein said teeth of the rotors are profiled with trochoidal curves.

3. A scroll compressor according to claim 1, wherein said hole is formed in the end of the connection portion of the orbiting scroll, a passage means is formed in the connection portion of the orbiting scroll for discharge of oil from the gear pump, and a seal means is provided between the connection portion of the oribiting scroll and the driving shaft for preventing a discharge side of the gear pump from communicating with the suction side thereof.

* * * * *